US008556360B2

(12) United States Patent
Chung et al.

(10) Patent No.: US 8,556,360 B2
(45) Date of Patent: Oct. 15, 2013

(54) TEXTILE PRINTING METHOD AND APPARATUS APPLYING INKJET PRINTER

(75) Inventors: Kwang-Choon Chung, Seoul (KR); Myoung-Seon Gong, Seoul (KR); Hoo-Shick Kim, Uiwang-si (KR); Ju-Jin Choi, Suwon-si (KR); Eun-Jin Park, Seoul (KR); Hyoung-Seok Kim, Daejeon (KR); Kyong-Min Lee, Seoul (KR)

(73) Assignee: Intec Co., Ltd. (KR)

( * ) Notice: Subject to any disclaimer, the term of this patent is extended or adjusted under 35 U.S.C. 154(b) by 602 days.

(21) Appl. No.: 12/474,684

(22) Filed: May 29, 2009

(65) Prior Publication Data

US 2009/0293209 A1 Dec. 3, 2009

Related U.S. Application Data

(63) Continuation-in-part of application No. 10/550,842, filed as application No. PCT/KR2004/000642 on Mar. 24, 2004, now abandoned.

(30) Foreign Application Priority Data

Mar. 25, 2003 (KR) ..... 10-2003-0018652

(51) Int. Cl.
*B41J 29/38* (2006.01)

(52) U.S. Cl.
USPC ..... 347/6; 347/85; 347/98; 347/101

(58) Field of Classification Search
USPC ..... 347/101, 6, 98, 85
See application file for complete search history.

(56) References Cited

U.S. PATENT DOCUMENTS

| | | | |
|---|---|---|---|
| 6,116,728 | A | 9/2000 | Miyake et al. |
| 6,142,619 | A | 11/2000 | Miura et al. |
| 6,153,263 | A | 11/2000 | Haruta et al. |

(Continued)

FOREIGN PATENT DOCUMENTS

| | | | |
|---|---|---|---|
| JP | 1996-18678 | A | 5/1996 |
| JP | 1996-11782 | A | 11/1996 |
| KR | 10-0146665 | B1 | 5/1998 |
| WO | 2004085739 | A2 | 10/2004 |

OTHER PUBLICATIONS

Chinese Office Action—Chinese Application No. 200480008099.4 dated Jul. 11, 2008.

(Continued)

*Primary Examiner* — Julian Huffman
(74) *Attorney, Agent, or Firm* — Cantor Colburn LLP

(57) ABSTRACT

A textile printing method applying inkjet printer comprises the steps for feeding a fabric by a fabric feed roller, applying a pretreatment liquid to the fabric by jetting the pretreatment liquid installed in a pretreatment liquid reservoir installed respective containers filled with individual compositions of a pretreatment liquid, so that such individual compositions are concurrently mixed and applied on the fabric surface to pretreat the fabric by operation of a control unit depending upon the fabric material through a pretreatment head, drying the pretreatment liquid applied to the fabric through a drier, and printing on the dried fabric by jetting the ink installed in a ink reservoir through the printing head. The pretreatment head, the drier and the printing head are serially arranged so that the steps for applying a pretreatment liquid, drying the pretreatment liquid and printing on the dried fabric are concurrently performed.

3 Claims, 4 Drawing Sheets

(56) References Cited

U.S. PATENT DOCUMENTS

| | | | | |
|---|---|---|---|---|
| 6,252,615 | B1 | 6/2001 | Yoshino | |
| 6,341,852 | B1 * | 1/2002 | Yamamoto | 347/85 |
| 2002/0025379 | A1 | 2/2002 | Nakamura et al. | |

OTHER PUBLICATIONS

International Search Report issued Jan. 10, 2009, corresponding to PCT/KR2004/000642.

* cited by examiner

TEXTILE PRINTING METHOD AND APPARATUS APPLYING INKJET PRINTER

CROSS REFERENCE TO RELATED APPLICATIONS

This application is a continuation-in-part-application of U.S. Ser. No. 10/550,842, filed Sep. 23, 2005, which is a national entry of PCT Application No. PCT/KR04/00642 filed on Mar. 24, 2004, which claims priority to and the benefit of Korean Application No. 10-2003-0018652 filed on Mar. 25, 2003, in the Korean Patent Office, the entire contents of which are incorporated herein by reference.

TECHNICAL FIELD

The present invention is to provide a method and an apparatus for pretreating a fabric by using an inkjet device, and further an inkjet printing method and an inkjet printing apparatus, including them. More particularly, the present invention is to provide a method for overcoming complication of the pretreating process due to diversification of materials by digitalizing a method for pretreating a fabric in an inkjet printing process by using an inkjet device, and further, an inkjet printing method for enabling the inkjet printing work to be continuously conducted on the basis of the said pretreatment.

Inkjet printing is a method of applying an inkjet printer to printing. The inkjet printing method has an advantage that it can satisfy desires of current consumers attaching importance to personality because factory automation is available through advancement of CAD/CAM using a computer system and it enables fine-expression like a photograph to be available, and further design synthesis, color change and shape modification to be easily and rapidly made so that small quantity batch production gets to be available. Also, this method enables energy to be saved and further brings about no environmental problem because it causes no residual paste to take place so that treatment of waste water resulting from it is not required. In this aspect, this inkjet printing method represents recent and rapid technical advancement in the printing industry.

The inkjet printing work is largely divided into three processes, which are a pretreatment process, a printing process and a post-treatment process.

The pretreatment process is to treat a fabric material in advance with a liquid composition and thereby prevent the jetted ink from bleeding or flowing in the fabric material when conducting the actual inkjet printing work, and further enhance the color developing property and the fastness thereof. In a conventional printing process, a color paste containing a dyestuff, a sizing agent and several conditioners for printing is used, while in the inkjet printing process, a dyestuff alone is used during the printing work and therefore, a process of pretreating the fabric material with a sizing agent and other conditioners for printing is separately required. This characteristic of the inkjet ink originates from the inkjet method for conducting the printing work by jetting the ink onto the fabric material. If the pretreatment process is omitted, the quality of the printed fabric gets to be coarse so that it gets to lose a value as a product.

The printing process is a step for conducting the actual inkjet printing work by jetting the ink onto the fabric material on the basis of the digitalized signal system.

The post-treatment process means that after conducting the inkjet printing work, the printed fabric gets to be dried and subsequently steamed and dry-heated, and then washed and dried.

In this inkjet printing process, the only digitalized process is the printing process, and the pretreatment process and the post-treatment process are still depending upon the analog system.

BACKGROUND ART

In the pretreatment process, the variety of pretreatment depending upon kinds of materials is so great due to characteristics of the fiber dyeing industry that pretreatment methods including a liquid composition ratio are minutely categorized according to types thereof. For example, in the case of silk, pretreatment methods include a knife hand pretreatment method, a padding method using a roller and the like. As a typical conventional pretreatment method, a mangle padding method is shown in FIG. 1. FIG. 1 shows a method for letting a fabric (12), which is fed by a feed roller, pass through a pretreatment liquid (13), squeezing the pretreatment liquid with which the fabric is stained through a mangle (11), and thereby applying the pretreatment liquid to the fabric. This mangle padding method is not suitable for a continuous batch process due to the characteristic of the printing process that the pretreatment liquid should be different according to the kind of textile or the kind of textile tissue. Even when only a part of the fabric is printed, the entire fabric should be pretreated so that the pretreatment liquid gets to be much wasted. Consequently, the mangle padding method requires a high cost and further it is likely to cause environmental pollution.

Also, if the pretreatment is conducted by a conventional method, it requires a given quantity of the fabric and the pretreatment liquid or more. This means that the fabric should be pretreated in advance and stored, and then whenever necessary, it should be printed, in view of the point that the inkjet printing method is adopted for the small quantity batch production system. If the pretreated fabric is stored, it gets to be damp due to the characteristic thereof or suffers a damage which gets to be a cause of defect, i.e., a scratch or the like when the inkjet printing work is actually conducted. Therefore, for meeting a small order, outputting a sample or maintaining the perfect quality, a method for pretreating the fabric just before conducting the inkjet printing work and consecutively conducting the inkjet printing work is required.

The present invention has been developed to solve the said problems, particularly to solve all problems occurring due to the use of the conventional analog processes, that is to say, the mangle padding method or the knife application method in pretreating the fabric in order to conducting the inkjet printing work. The present invention is to provide a method for conducting the inkjet printing work flexibly, consistently and continuously depending upon various kinds and tissues of fibers by developing a pretreatment liquid composition suitable for the inkjet printer as controlled by the digital signal system, applying it to the fabric material by the inkjet printing method, and enabling the liquid composition to be changed or the application thickness to be finely adjusted depending upon the kind and the tissue of each fabric material. Thereby, the present invention is to provide a printing method for ensuring that the quality of the printed fabric is uniform and perfectly reproducible by enabling the pretreatment of the fabric and the subsequent inkjet printing work to be consecutively conducted.

DISCLOSURE OF THE INVENTION

The present invention is to provide a method for overcoming complication of the pretreating process due to diversification of materials by digitalizing a method for pretreating a fabric in the inkjet printing process by using the inkjet device, and further, an inkjet printing method for enabling the inkjet printing work to be continuously conducted on the basis of the said pretreatment.

The present invention comprises two methods using the inkjet device and a continuous process system for enabling them to be executed.

One of the two methods is a method for manufacturing each suitable pretreatment liquid for each fabric material applicable to an inkjet printer head, filling a pretreatment liquid container with it, and pretreating the fabric with each suitable pretreatment liquid as selected through the pretreatment head by the control unit thereof, depending upon the fabric material (hereinafter referred to as a whole application method), and the other one is a method for filling each pretreatment liquid container with an individual component of the pretreatment liquid by components and pretreating the fabric by applying each suitable pretreatment liquid to the fabric while at the same time respective components of the each suitable pretreatment liquid are mixed appropriately through the pretreatment head by the control unit thereof (hereinafter referred to as an individual application method). Hereinafter, in order to distinguish the two methods from each other, the former is referred to as a whole application method and the latter is referred to as an individual application method.

If the pretreating method is constituted as above described, any fabric material can be pretreated with a suitable pretreatment liquid even if the conventional pretreating method or the pretreatment liquid to be changed depending upon the kind of the fabric material is not used, and therefore, it enables a continuous process to be executed in the inkjet printing work.

Hereinafter, the present invention is described by reference to the accompanying drawings.

FIG. 2 is a schematic view showing one example of the apparatus for pretreating a fabric material by applying the pretreatment liquid to it through an inkjet device according to the present invention.

This apparatus comprises a fabric feed roller (25) for feeding the fabric, a pretreatment head (24) which can be reciprocated from side to side, a pretreatment liquid reservoir (23) where each pretreatment liquid container containing an individual pretreatment liquid suitable for each fabric material can be received or removed, a control unit (22) for controlling application of the pretreatment liquid, and a winding roller (26) which can receive the fabric pretreated through the pretreatment head.

The fabric fed by the fabric feed roller (25) is applied with the pretreatment liquid through the pretreatment head (24), and then, it is dried (not shown), winded and received by the winding roller (26). The pretreatment liquid reservoir (23) contains respective pretreatment liquids to be respectively applied suitably for the kind of the fabric material. When the user selects the kind of the fabric material through a computer system, the control unit (22) works to apply the pretreatment liquid suitable for the fabric material to it according to the working principle of the inkjet printer.

The pretreatment liquid composition for inkjet printing of the fabric according to the present invention varies depending upon the kind of each fabric material, but it is largely composed of following components:

1) Sizing Agent

The sizing agent has a function to control the diffusion velocity of pigment in a fiber so that it may be uniform. It comprises mainly water soluble polymer and typical sizing agents include sodium alginate, carboxyl methyl cellulose, hydroxyl ethyl cellulose, xanthan gum, Arabic gum and the like.

2) Anti-Bleeding Agent

The anti-bleeding agent has a function to fix pigment to the fiber without bleeding when pigment is dropped onto the fiber, and also another function to enhance the color developing property. It may not be used because it may deteriorate the feel of the fabric material. These anti-bleeding agents include silica, alumina, cationized agent and the like. In the case of silica, it may be used in the form of silica sol which is of an independent dispersion type, and it may be also used after completion of a dispersing process by adding a dispersing agent thereto.

3) pH Control Agent (Buffer Agent)

The pH control agent has a function to control pH of the pretreatment liquid. For example, when a cotton material is printed with the reactive dye ink, sodium bicarbonate ($NaHCO_3$) is added thereto to maintain low alkalinity thereof. When silk and the like are printed with the acidic dye ink, a weak acid, such as tartaric acid ammonium, is added thereto to control pH. When polyester and the like are printed with the disperse dye ink, inert organic acid, such as citric acid, is added thereto to control pH.

4) Hydrotropic Agent

The hydrotropic agent has a function to increase the moisture content of the fiber or to enhance the solubility of dye. These hydrotropic agents include urea, thiourea and the like.

5) Surfactant

The surfactant has a function to enhance the permeability of dye into the fiber. Some surfactants also function as a sizing agent. These surfactants include nonionic surfactants, anionic surfactants and the like.

6) Other Conditioners

In addition to the above components 1) to 5), neutral salt, an anti-reducing agent, a humectant and the like may be contained therein. Neutral salt is a conditioner to accelerate dyeing exhaustion, which is mainly applied to the cotton fiber. As neutral salt, sodium chloride, sodium sulfate and the like are available. The anti-reducing agent is a substance to be added in order to prevent a developing concentration from going down by preventing the dye from being reduced. These anti-reducing agents include meta-nitrobenzene sulfonic acid and the like. The humectant has a function to moisturize the fabric material so that it may be suitable for the inkjet head, and also another function to control the viscosity thereof. Usually, as the humectant, ethylene glycol, propylene glycol and the like are available.

According to the present invention, for the whole application method, components of the said pretreatment liquid were mixed in various proportions, and thereby 2 to 8 kinds of pretreatment liquids, each of which was applicable to each suitable fabric material, were manufactured so that each fabric material might be pretreated with each suitable pretreatment liquid through the inkjet printer. This pretreatment liquid can be manufactured by mixing such components by a conventional method. The viscosity thereof was adjusted in the range of 2.0 cP~20 cP so as to make it suitable for the currently commercialized inkjet head. Also, it was conditioned so that it might be a solution of which the surface tension was in the range of 30~70 $N/cm^2$. The said surface tension values were on the basis of measurements by a surface tension meter as manufactured by Fisher Scientific Inc. (brand name: Surface Tensiomat 21). The viscosity thereof was measured by a viscometer as manufactured by Brookfield Inc. (brand name: DV-II+Viscometer). This mixed pretreatment liquid is made to pass through a filter to remove any impurities and insoluble matters from it. Thereby, the pretreatment liquid is manufactured.

Here, the material means the fabric. Typical fabric materials include silk, wool, cotton, polyester, nylon and the like. Various kinds of pretreatment liquids, which are applicable to respective suitable materials, are manufactured in advance by the said method, and each pretreatment liquid container is filled with each pretreatment liquid. Then, all the pretreatment liquid containers are installed in the pretreatment liquid reservoir (23) of the pretreating apparatus (21). Then, each suitable pretreatment liquid for the fabric gets to be applied to the fabric through the pretreatment head (24) by the control unit (22) as controlled by the user's computer system.

Also, there is a case that the application amount of the pretreatment liquid should be adjusted suitably for the tissue of each material. The tissue means the pattern woven of the raw yarn of each material. Kinds of tissues include plain weave, twill weave and satin weave. More specifically, the plain weave includes poplin, canvas, mesh and the like. The twill weave includes jean, denim and the like. The satin weave includes charmeuse, cretonne and the like.

For a material of which the fiber tissue is thick and dense, the application amount of the pretreatment liquid should be increased in proportion thereto so that the whole tissue can be uniformly pretreated. Therefore, for controlling the application amount of the pretreatment liquid to be applied, the number of application times can be adjusted or the application thickness can be adjusted so that it may be suitable for each material by increasing the application amount through the pretreatment head by the control unit.

For example, in the case that the material is thin like a silk mesh, even one time of application can make the pretreatment work to be satisfactory, but for a thick material like 20 counts of Oxford, the pretreatment work required for each material can be performed by applying the suitable pretreatment liquid to it several times through the pretreatment head.

FIG. 4 is a schematic view of an application apparatus using the inkjet method according to the individual application method of the present invention. The structure of the pretreating apparatus in FIG. 4 is the same as that in FIG. 3, but each pretreatment liquid container is filled with each component of the pretreatment liquid.

According to the individual application method of the present invention, the fabric fed by the fabric feed roller is applied with the pretreatment liquid through the pretreatment head (44), and then, it is dried (not shown), and winded and received by the winding roller. The pretreatment liquid reservoir (43) includes containers and each container is filled with individual compositions of the pretreatment liquid. When the type of the fabric material is determined, individual compositions are fed to the pretreatment head by the control unit in order to apply the pretreatment liquid selected according to the fabric materials. The individual compositions are applied and concurrently mixed on the fabric surface through the pretreatment head. The principle of applying the pretreatment liquid is derived from a general principle for discharge. Accordingly, the ratios of each individual composition of the pretreatment liquid which are different according to the kind of the fabric materials are provided.

Respective individual liquid compositions comprise 1) a liquid composition containing a sizing agent, 2) a liquid composition containing an anti-bleeding agent such as silica, 3) a liquid composition containing a pH control agent of an acidic dye ink, 4) a liquid composition containing a pH control agent of a disperse dye ink, 5) a liquid composition containing a pH control agent of a reactive dye ink, 6) a liquid composition containing a hydrotropic agent and the like, and if necessary, it may comprise additionally a liquid composition containing a surfactant, a liquid composition containing neutral salt, a liquid composition containing an anti-reducing agent and the like.

For the pretreating apparatus to which a conventional inkjet printer is applied, various numbers of containers to be filled respectively with each pretreatment liquid composition can be installed in the range of 4 to 8. Also, because it is easy to install or remove any of them, a pretreatment liquid composition to be required for a certain material can be individually selected and used.

The liquid composition to be discharged by the control unit through controlling signals of the user's computer system gets to be varied depending upon materials or tissues, and the pick-up rate gets to be also varied. This individual application method is suitable in the case that different materials, such as silk, cotton, polyester and the like, are continuously inkjet-printed. The individual pretreatment liquid composition can be also manufactured by mixing components thereof by a conventional method. The viscosity and surface tension thereof are respectively adjusted in the range of 2.0 cP~20 cP and 30~70 N/cm$^2$ so that it may be made to be suitable for the currently commercialized inkjet head.

The surface tension and the viscosity as mentioned above are what were measured by the same instruments as used for the whole application method. This mixed pretreatment liquid is made to pass through a filter to remove any impurities and insoluble matters from it. Then, the pretreatment liquid is used.

The discharge, the non-discharge, the number of repetition times and the discharging amount of the individual pretreatment liquid can be set up by combining the number of respective cases by building up a database on suitable conditions thereof for each material and programming them. These characteristics of pretreatment for the inkjet printing are consistent with attributes of the textile printing for an unlimited number of materials.

FIG. 5 is a perspective view showing one example of a continuous inkjet printing apparatus including the pretreating method using the inkjet according to the present invention.

This apparatus comprises a fabric feed roller (55) for feeding a fabric, a conveying roller (57, 57') for conveying a fabric, a pretreatment head (52), a dryer (53), a printing head (54) and a control unit for controlling them respectively, and a winding roller (56) for winding and keeping the final printed fabric, wherein the pretreatment head (52), the dryer (53), the printing head (54) are arranged parallel to one another.

The fabric (51) fed by the fabric feed roller (55) is applied with a pretreatment liquid through the pretreatment head (52) consecutively as it is conveyed by the conveying roller (57), dried by the dryer (53), printed through the printing head (54), and re-winded and received by the winding roller (56). For application of the pretreatment liquid, the whole application method or the individual application method can be selectively used. The dryer is a device for enabling the pretreatment chemical to be rapidly dried as it is located between the pretreatment head (52) and the printing head (54). Drying methods include a microwave heating method, an infrared ray heating method, a heater heating method and the like, but they are not limited thereto. It can be constructed in a fixed type by fitting it to the width of the fabric or it can be constructed as a small device in a movable type enabling it to be reciprocally moved by fitting it to a small size.

As the pretreatment work is performed by using the inkjet device as described above, a continuous process gets to be available in the inkjet printing process.

FIG. 6 is a perspective view showing another example of the continuous inkjet printing apparatus including the pretreating method using the inkjet according to the present invention.

This apparatus is what a pretreating device and a drying device are added to an ordinary inkjet printing apparatus, and its main components comprise a pretreatment liquid control unit (62), a pretreatment liquid reservoir (63), a printing control unit (64), an ink reservoir (65), a pretreatment head (66), a dryer (67), and a printing head (68), wherein the pretreatment head (66), the dryer (67), the printing head (68) are arranged parallel to one another.

The fabric (69) fed by the fabric feed roller can get to be printed as it passes through the pretreatment device (66), the dryer (67) and the printing device (68) consecutively. The pretreatment liquid as selected from the pretreatment liquid reservoir (63) can be applied to the fabric by the pretreatment liquid control unit (62). As this application method, either of the said whole application method or the individual application method may be used. Then, the fabric is dried by the dryer (67) and printed by the printing device as controlled by the control unit (64), using the ink selected from the ink reservoir (65). The printing device (68) is controlled by a controller (64) from the ink reservoir (65). FIG. 7 is a sectional view showing a cross-section of the apparatus as shown in FIG. 6.

FIG. 8 is a perspective view showing another example of the continuous inkjet printing apparatus including a pretreating method using the inkjet according to the present invention.

This apparatus is what enables the continuous inkjet printing to be executed by constructing a combined apparatus in which a pretreatment head (86), a dryer (87) and a printing head (88) are serially arranged. The other components are as shown in FIG. 7.

The fabric fed by the fabric feed roller can be concurrently pretreated, dried and printed by a single time of one-way movement of the combined apparatus.

This continuous process system is filled with pretreatment liquids of the said two types and a commercial or self-manufactured ink for inkjet printing, and then, the printing work is conducted by programming variously depending upon fibers and tissues. Thereby, a perfect continuous printing process can be realized in the fiber inkjet printing.

For the inkjet printer or the inkjet head which can be used in the present invention, any inkjet method for forming and jetting ink droplets by thermal, mechanical and electrical energy, such as inkjet of a continuous type, inkjet of a piezo type and of a thermal type according to the drop-on-demand method, may be selected and used.

Inks for textile inkjet printing, which can be used in the present invention, may include not only an acidic ink of a water based type, a reactive ink, a dispersing ink and a pigment ink but also a dispersing ink of a solvent type, a reactive dispersing ink and a pigment ink.

Various materials which can be printed according to the present invention include polyester, cotton, silk, wool, nylon, span, blending fiber and the like, but they are not limited to any specific fibers. Also, the present invention is applicable to a various range of fabric tissues, such as fabric, knit, and non-woven fabric. Particularly, irrespective of plain weave, twill weave and stain weave in the fabric tissue, the fabric can be beautifully printed continuously.

For the said fabric as pretreated and printed, the dye is fixed to the fiber by the traditional post-treatment method as publicly known, such as a steaming method, a dry heating method, a high temperature steaming method and the like. The process according to this method is executed according to the method as publicly known in such technical field. Further, the printed fabric to which the dye is fixed is washed in a special manner, as needed, such as reduction washing, stain-proofing agent-based washing, and then it is washed by using a neutral detergent and completely rinsed with clean water. Then, it goes through a drying process. Thereby, a finished product is manufactured.

BEST MODE FOR CARRYING OUT THE INVENTION

Figure 1:
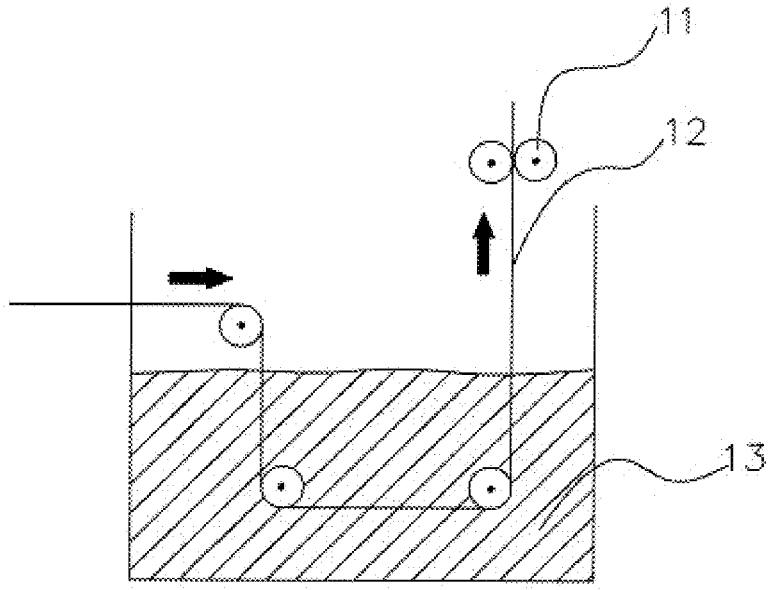
FIG. 1 is a sectional view showing one example of the pretreating method according to a prior art.
Figure 2:
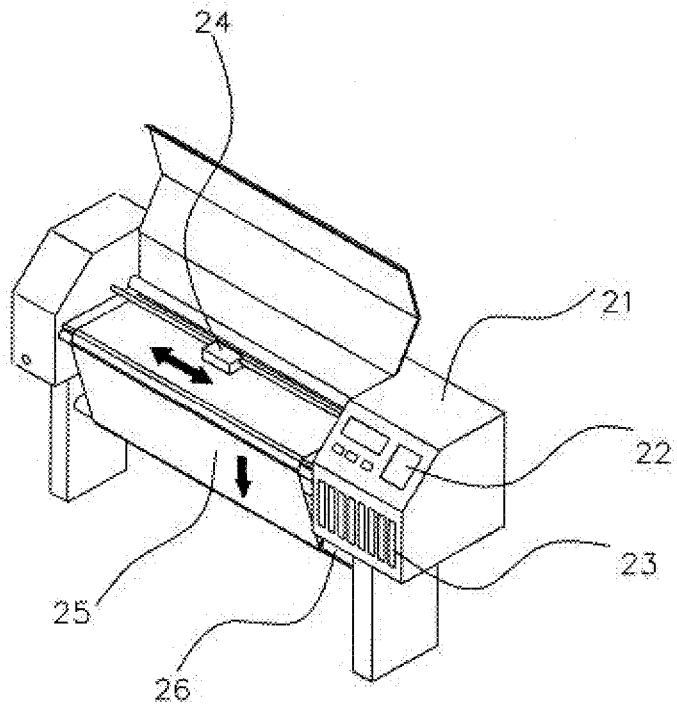
FIG. 2 is a perspective view showing one example of the apparatus for applying the pretreatment mixed liquid by the inkjet method according to the present invention
Figure 3:
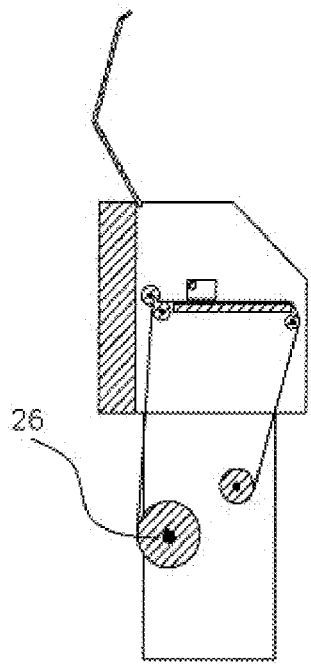
FIG. 3 is a sectional view of the apparatus as shown in FIG. 2.
Figure 4:
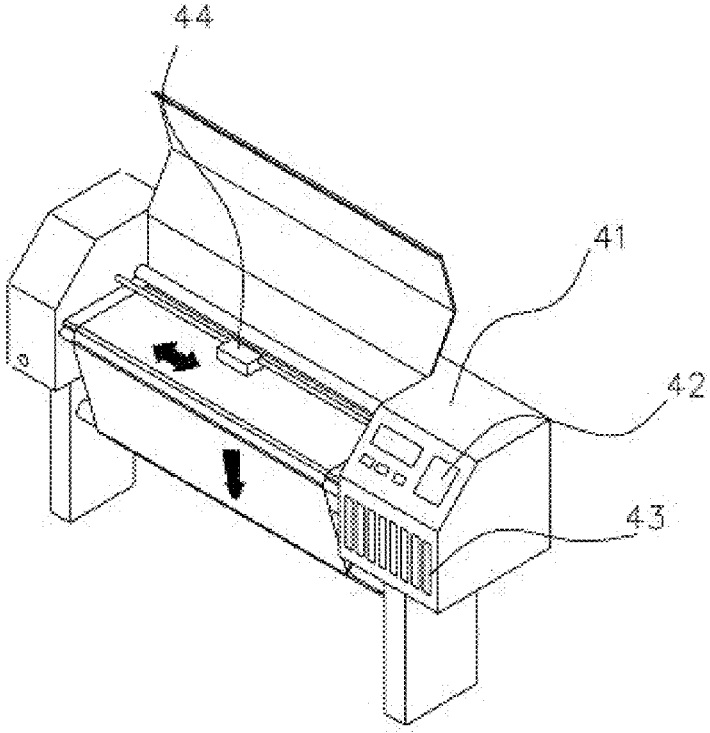
FIG. 4 is a perspective view showing one example of the apparatus for applying by the inkjet method according to the individual application method of the present invention.
Figure 5:
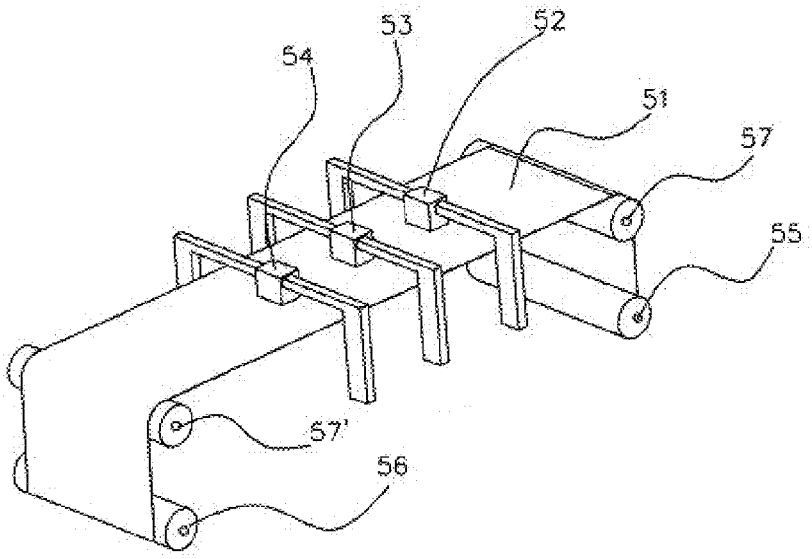
FIG. 5 is a perspective view showing one example of the continuous inkjet printing apparatus including the pretreating method using the inkjet device according to the present invention.
Figure 6:
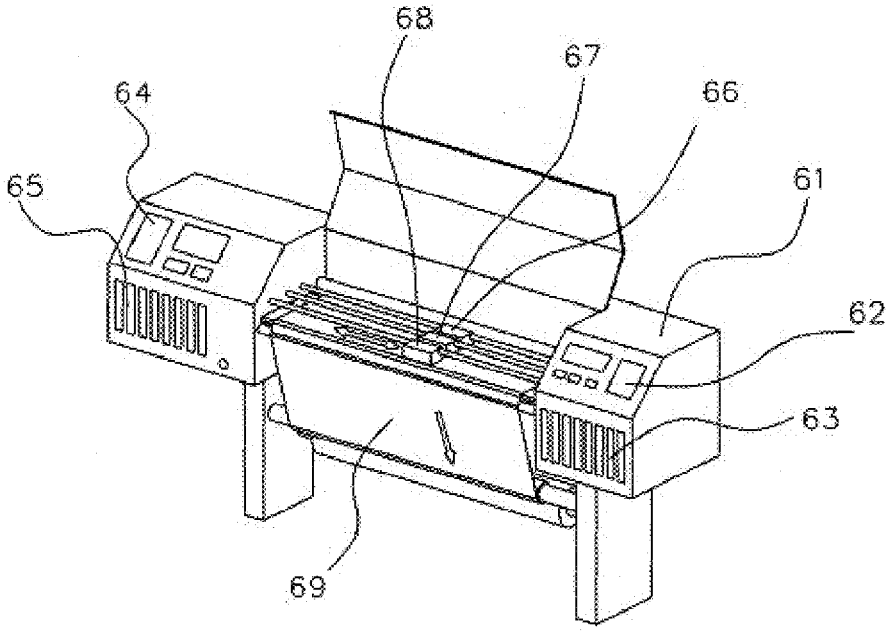
FIG. 6 is a perspective view showing another example of the continuous inkjet printing apparatus including a pretreating method using the inkjet device according to the present invention.
Figure 7:
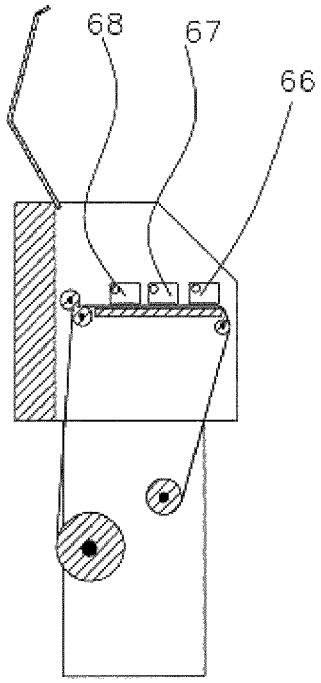
FIG. 7 is a sectional view of the apparatus as shown in FIG. 6.
Figure 8:
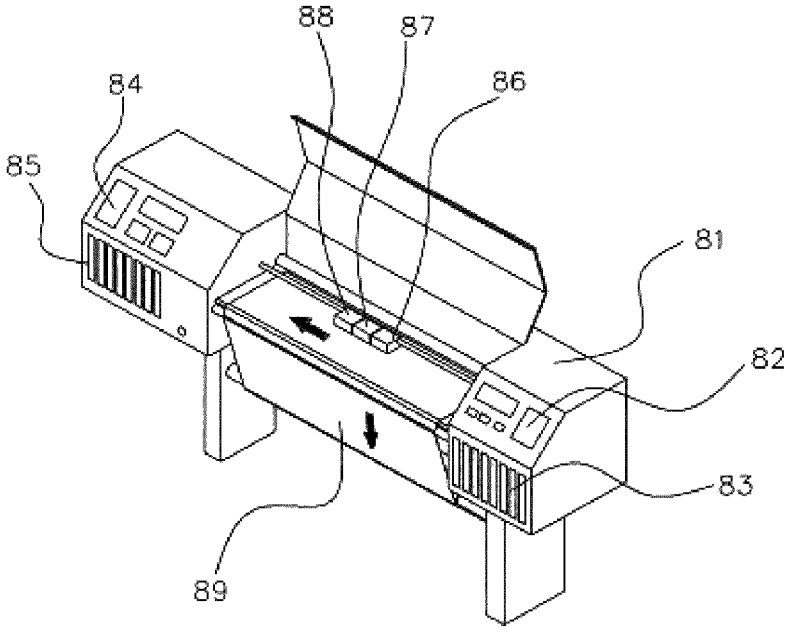
FIG. 8 is a perspective view showing another example of the continuous inkjet printing apparatus including a pretreating method using the inkjet device according to the present invention.

Following examples are described to help understand the present invention, and processes from the manufacture of the pretreatment liquid to the printing and the results are exemplified. In order to avoid a long and tedious description, the pretreatment liquid used for pretreatment according to the present invention is limited to examples applied to three materials (cotton, silk and polyester), but as a matter of course, the present invention is not limited thereto. Unless mentioned otherwise, percent (%) means wt. %.

Example 1

Manufacture of a Pretreatment Liquid

1) Manufacture of Pretreatment Mixed Liquid 1

| | |
|---|---|
| Glycerin | 5% |
| Carboxyl methyl cellulose | 1.5% |
| Urea | 5% |
| Triton X-100 | 5% |
| (brand name: manufactured by Union Carbide) | |
| Sodium bicarbonate | 5% |
| Purified water | the rest amount |

The said respective substances were put into a suitable container, and then it was sufficiently agitated by using an agitator. Then, the agitated mixed liquid was let to pass through a membrane filter (manufactured by MFS, using cellulose acetate or nitrocellulose as a membrane material). Thereby, a pretreatment liquid for a reactive dye ink was manufactured.

2) Manufacture of Pretreatment Mixed Liquid 2 (Silk: Satin)

| | |
|---|---|
| Glycerin | 5% |
| Hydroxyl ethyl cellulose | 2.5% |
| Urea | 5% |
| Triton X-100 | 0.5% |
| (brand name: manufactured by Union Carbide) | |
| Ammonium tartrate | 2.5% |
| Purified water | the rest amount |

By agitating the above substances and letting the agitated mixed liquid pass through a filter in the same method as in the above 1), a pretreatment liquid for an acid dye ink was manufactured.

3) Manufacture of Pretreatment Mixed Liquid 3

| | |
|---|---|
| Glycerin | 5% |
| Carboxyl methyl cellulose | 1.5% |
| Urea | 5% |
| Triton X-100 | 0.5% |
| (brand name: manufactured by Union Carbide) | |
| Citric acid | 0.1% |
| Purified water | the rest amount |

By agitating the above substances and letting the agitated mixed liquid pass through a filter in the same method as in the above 1), a pretreatment liquid for a disperse dye ink was manufactured.

Example 2

Pretreatment Using the Pretreatment Liquid of Example 1 and Inkjet Printing

Each pretreatment liquid container of the pretreating apparatus, in which the F055030 head (brand name: manufactured by Epson) was installed, was filled with each pretreatment liquid manufactured in Example 1, and each fabric of cotton (40 counts, plain weave), silk (satin) and polyester (charmeuse) was pretreated by applying each suitable pretreatment liquid to each fabric through the pretreatment head controlled by the control unit depending upon the kind of each fabric. Each pretreated fabric was printed in each ink suitable for each material, that is to say, cotton was printed in Cibacron MI (manufactured by Ciba-Geigy), the reactive ink, silk was printed in LANASET SI (manufactured by Ciba-Geigy), and polyester was printed in TERASIL DI (manufactured by Ciba-Geigy). After printing each fabric, cotton (40 counts, plain weave) was maintained at 102° C. for 12 minutes in a steamer (steaming device) to fix the dye thereto, silk (satin) was steamed at 102° C. for 20 minutes and polyester (charmeuse) was dry-heated at 170° C. Then, each fabric was washed with a neutral detergent and clean water and dried by a dryer. By discharging each pretreatment liquid through inkjet differently depending upon the kind of each material and performing the inkjet printing work consecutively, prints of good quality could be obtained.

Example 3

Manufacture of Individual Component Compositions of a Pretreatment Liquid

1) Manufacture of a Sizing Agent Composition (A)

| | |
|---|---|
| Hydroxyl ethyl cellulose | 5% |
| Glycerin | 2% |
| FLUORAD FC170 | 0.3% |
| Purified water | the rest amount |

The said respective substances were put into a suitable container, and then it was sufficiently agitated by using an agitator. Then, the agitated mixed liquid was let to pass through a membrane filter (manufactured by MFS, using cellulose acetate or nitrocellulose as a membrane material). Thereby, a sizing agent composition (A) was manufactured.

2) Manufacture of a Humectant Composition (B)

| | |
|---|---|
| Urea | 5% |
| Glycerin | 2% |
| FLUORAD FC170 | 0.3% |
| Purified water | the rest amount |

By agitating the above substances and letting the agitated mixed liquid pass through a filter in the same method as in the above 1) of Example 3, a humectant composition (B) was manufactured.

3) Manufacture of a pH Control Agent Composition (C) for the Reactive Dye Ink

| | |
|---|---|
| Sodium bicarbonate | 5% |
| Glycerin | 2% |
| FLUORAD FC170 | 0.3% |
| Purified water | the rest amount |

By agitating the above substances and letting the agitated mixed liquid pass through a filter in the same method as in the above 1) of Example 3, a pH control agent composition (C) for the reactive dye ink was manufactured.

4) Manufacture of a pH Control Agent Composition (D) for the Acidic Dye Ink

| | |
|---|---|
| Ammonium tartrate | 5% |
| Glycerin | 2% |
| FLUORAD FC170 | 0.3% |
| Purified water | the rest amount |

By agitating the above substances and letting the agitated mixed liquid pass through a filter in the same method as in the above 1) of Example 3, a pH control agent composition (D) for the acidic dye ink was manufactured.

5) Manufacture of a pH Control Agent Composition (E) for the Disperse Dye Ink

| | |
|---|---|
| Citric acid | 5% |
| Glycerin | 2% |

-continued

| | |
|---|---|
| FLUORAD FC170 | 0.3% |
| Purified water | the rest amount |

By agitating the above substances and letting the agitated mixed liquid pass through a filter in the same method as in the above 1) of Example 3, a pH control agent composition (E) for the disperse dye ink was manufactured.

6) Manufacture of a Surfactant Composition (F)

| | |
|---|---|
| Triton X-705 (brand name: manufactured by Union Carbide) | 5% |
| Glycerin | 2% |
| FLUORAD FC170 | 0.3% |
| Purified water | the rest amount |

By agitating the above substances and letting the agitated mixed liquid pass through a filter in the same method as in the above 1) of Example 3, a surfactant composition (F) was manufactured.

Example 4

Pretreatment Using Individual Compositions of a Pretreatment Liquid as Manufactured in Example 3 and Inkjet Printing Each pretreatment liquid container of the pretreating apparatus, in which the F055030 head (brand name: manufactured by Epson) was installed, was filled with 6 individual compositions for a pretreatment liquid as manufactured in Example 3, and each fabric of cotton (40 counts, plain weave), silk (satin) and polyester (charmeuse) was pretreated by applying each suitable pretreatment liquid to each fabric through the pretreatment head controlled by the control unit depending upon the kind of each fabric. Each suitable pretreatment liquid was discharged as programmed in the user's computer connected with the said printer's control unit. Polyester (charmeuse) was pretreated by discharging "A", "B", "E" and "F" one time in the order named. Silk (satin) was pretreated by discharging "A", "B", "D" and "F" two times in the order named. Cotton (40 counts, plain weave) was pretreated by discharging "A", "B", "C" and "F" two times in the order named. Each pretreated fabric was sufficiently dried by the dryer, and then each pretreated fabric was printed in each ink suitable for each material, that is to say, cotton was printed in Cibacron MI (manufactured by Ciba-Geigy), the reactive ink, silk was printed in LANASET SI (manufactured by Ciba-Geigy), and polyester was printed in TERASIL DI (manufactured by Ciba-Geigy). After printing each fabric, cotton (40 counts, plain weave) was maintained at 102° C. for 12 minutes in a steamer (steaming device) to fix the dye thereto, silk (satin) was steamed at 102° C. for 20 minutes and polyester (charmeuse) was dry-heated at 170° C. Then, each fabric was washed with a neutral detergent and clean water and dried by a dryer. By discharging individual compositions of a pretreatment liquid through inkjet differently depending upon the kind of each material and performing the inkjet printing work consecutively, prints of good quality could be obtained.

As described above, the present invention can provide a method for overcoming complication of the pretreating process due to diversification of materials by digitalizing a method for pretreating a fabric in an inkjet printing process by using an inkjet device, and further, an inkjet printing method for enabling the inkjet printing work to be continuously conducted on the basis of the said pretreatment.

What is claimed is:

1. A method of printing a textile by applying an inkjet printer, the method comprising:

feeding a fabric by a fabric feed roller;

selecting, through a control unit, at least one pretreatment liquid component to be applied from a plurality of pretreatment liquid components installed in a pretreatment liquid reservoir, depending upon a type of the fed fabric, and determining, through the control unit, an application ratio of the selected at least one pretreatment liquid component;

controlling, by the control unit, a pretreatment head such that the selected at least one pretreatment liquid component is mixed based on the determined application ratio and is applied to the fed fabric, wherein an application amount of the selected at least one pretreatment liquid component or a frequency at which the selected at least one pretreatment liquid component applied to the fabric is adjusted depending upon the type of the fed fabric;

drying the selected at least one pretreatment liquid applied to the fabric through a dryer; and printing on the dried fabric by jetting an ink installed in an ink reservoir through a printing head.

2. An apparatus for printing a textile by applying an inkjet printer, the apparatus comprising:

a feed roller for feeding a fabric;

a pretreatment liquid reservoir filled with a plurality of pretreatment liquid components;

a pretreatment head for applying a pretreatment liquid to the fabric fed by the feed roller;

a dryer for drying the pretreatment liquid applied to the fabric by the pretreatment head;

a printing head for printing on the dried fabric in the dryer by jetting an ink;

an ink reservoir for feeding the ink to the printing head; and a control unit for selecting at least one pretreatment liquid component to be applied from the plurality of pretreatment liquid components installed in the pretreatment liquid reservoir depending upon a type of the fed fabric, determining an application ratio of the selected at least one pretreatment liquid component, and controlling the pretreatment head such that the selected at least one pretreatment liquid component is mixed based on the determined application ratio and is applied to the fed fabric, wherein an application amount of the selected at least one pretreatment liquid component or a frequency at which the selected at least one pretreatment liquid component is applied to the fabric is adjusted depending upon the type of the fed fabric.

3. The apparatus of claim 2, wherein the pretreatment head, the dryer, and the printing head are arranged in series or in parallel such that a pretreating work, a drying work and a printing work are performed in a consecutive order.

* * * * *